US005127559A

United States Patent [19]

Freer et al.

[11] Patent Number: 5,127,559

[45] Date of Patent: Jul. 7, 1992

[54] GARMENT-HANGER-CARD ASSEMBLY

[75] Inventors: Geraldine E. Freer, Los Angeles; Robert S. Marx, Beverly Hills, both of Calif.

[73] Assignee: Robert Marx, Inc., Los Angeles, Calif.

[21] Appl. No.: 669,102

[22] Filed: Mar. 13, 1991

[51] Int. Cl.[5] ..... A47G 25/14

[52] U.S. Cl. ..... 223/85; 40/322; 223/98; 223/87

[58] Field of Search ..... 223/87, 85, 88, 92, 223/98; 40/322; 206/232, 281, 300, 299, 297, 296, 292, 284, 286, 289; D6/328

[56] References Cited

U.S. PATENT DOCUMENTS

| | | | |
|---|---|---|---|
| 1,638,375 | 8/1927 | Stutz | 223/87 |
| 2,172,206 | 9/1939 | Katz | 40/322 |
| 2,380,375 | 7/1945 | Axelrod | 206/281 |
| 2,857,696 | 10/1958 | Barrow | 40/322 |
| 2,976,990 | 3/1961 | Nevai | 40/322 |
| 3,252,565 | 5/1966 | Abbey | 223/87 |
| 3,398,839 | 8/1968 | Ballenger | 223/87 |
| 3,704,778 | 12/1972 | Raschdorf | 206/292 |

FOREIGN PATENT DOCUMENTS

| | | | |
|---|---|---|---|
| 2653583 | 1/1978 | Fed. Rep. of Germany | 206/241 |

*Primary Examiner*—Werner H. Schroeder
*Assistant Examiner*—Bibhu Mohanty
*Attorney, Agent, or Firm*—Poms, Smith, Lande & Rose

[57] ABSTRACT

A merchandising assembly for bras or other garments includes (1) a garment having shoulder straps, (2) a hanger including a hook, a transverse bar connected directly to said hook and clips at the ends of the bar for holding the shoulder straps of the garment, and (3) a folded sheet having a front panel and a rear panel, and an opening along the fold of the sheet for receiving the hook of the hanger, so that the front panel of the sheet may extend down within the garment, and the rear panel may extend down outside the rear of the garment to avoid entanglement with adjacent garments when several of the assemblies are closely mounted on a rack. Advertising and product information may be located on the exposed surfaces of said panels.

20 Claims, 3 Drawing Sheets

FIND YOUR FIT
| | 32 | 34 | 36 | 38 |
|---|---|---|---|---|
| B CUP | 111111 111111<br>111111 111111 | 111111 222222<br>111111 222222 | 222222 333333<br>222222 333333 | 333333 333333<br>333333 333333 |
| C CUP | 111111 111111<br>111111 111111 | 222222 222222<br>222222 222222 | 333333 333333<br>333333 333333 | 444444 444444<br>444444 444444 |
| D CUP | 111111 222222<br>111111 222222 | 222222 333333<br>222222 333333 | 333333 444444<br>333333 444444 | 444444 444444<br>444444 444444 |
FIG. 4
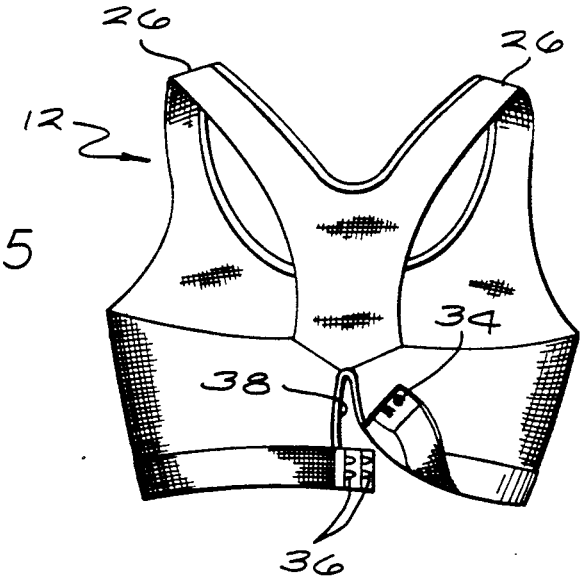
FIG. 5
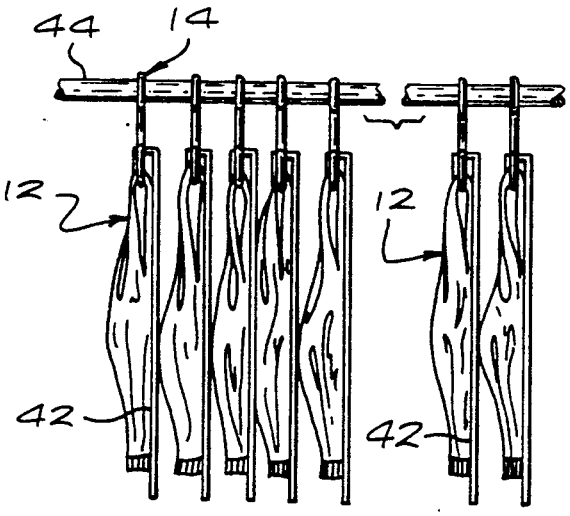
FIG. 6

GARMENT-HANGER-CARD ASSEMBLY

FIELD OF THE INVENTION

This invention relates to merchandising assemblies for brassieres, or bras, or other garments.

BACKGROUND OF THE INVENTION

It is customary in the sale of bras to have them mounted on hangers, with hang tags secured to the bras by the usual plastic holders or ties having T-shaped arrangements firmly securing the tags to the bras. These arrangements have several drawbacks. First, the adjacent bras tend to become tangled with one another. Second, it is difficult to try on the bras with the plastic ties and product hang tags secured to the bras, and the prospective customer is often reluctant to cut the plastic ties to try on the product. As an additional point, selecting the proper size, for a sport bra, for example, involves a combination of bust cup size and the chest circumference immediately below the bust; and with the usual bra merchandising arrangements it is not convenient to provide this information, so that proper fit and size selection may involve trying on several bras.

Accordingly, a principal object of the current invention is to overcome the foregoing problems in the merchandising of bras and other similar products.

It is noted in passing that hanger tags have been proposed previously for use with mens socks or trousers, and such arrangements are shown in W. L. Lhamon U.S. Pat. No. 2,324,093; F. S. Russell U.S. Pat. No. 4,190,151; and S. J. Kunreuther U.S. Pat. No. 4,601,417. However, none of these prior arrangements are intended for use with bras or similar types of clothing, and do not have the configurations needed to solve the problems outlined hereinabove.

SUMMARY OF THE INVENTION

In accordance with the present invention, a plastic hanger for bras or similar garments is provided with an upwardly extending hook, and a transverse bar or member, with securing arrangements for holding the shoulder straps or other portions of the garment at each end of the transverse bar; and a folded sheet having front and rear panels has an opening at the center of the fold to receive the hook, with the front panel extending down inside the garment and the rear panel extending down behind the garment.

In accordance with one illustrative specific embodiment for use with bras, the hanger bar is about seven or eight inches in width, and the bra straps are secured by clips at the ends of the hangar bar; and the folded card was about 6 or 7 inches wide and about 10 or 11 inches in vertical extent. The front of the front panel of the folded sheet may carry advertising material, and the back of the rear panel may carry fit and size information. With the back panel extending down outside the bra assembly, adjacent garments do not become entangled by the engagement of the bra closure hooks with adjacent garments, or otherwise. Further, the low cut of the neckline of most bras permits the display of timely and fashionable advertising material on the front of the front panel.

In accordance with a collateral advantage of the invention, the bras do not require the use of hang tags secured by plastic ties to the garment, so that it is easy and convenient for prospective purchasers to try on the garment.

Other objects, features and advantages of the invention will become apparent in the course of a consideration of the following detailed description and the accompanying drawings.

BRIEF DESCRIPTION OF THE DRAWINGS

FIG. 4 is an enlarged showing of the size and fit table shown on the backside of the rear panel of the folded sheet as shown in FIG. 3;

FIG. 5 is a rear view of the sport bra included in FIG. 1; and

FIG. 6 shows several bra hanger assemblies illustrative of the invention hung side-by-side on a support rod.

DETAILED DESCRIPTION OF PREFERRED EMBODIMENT

Figure 1:
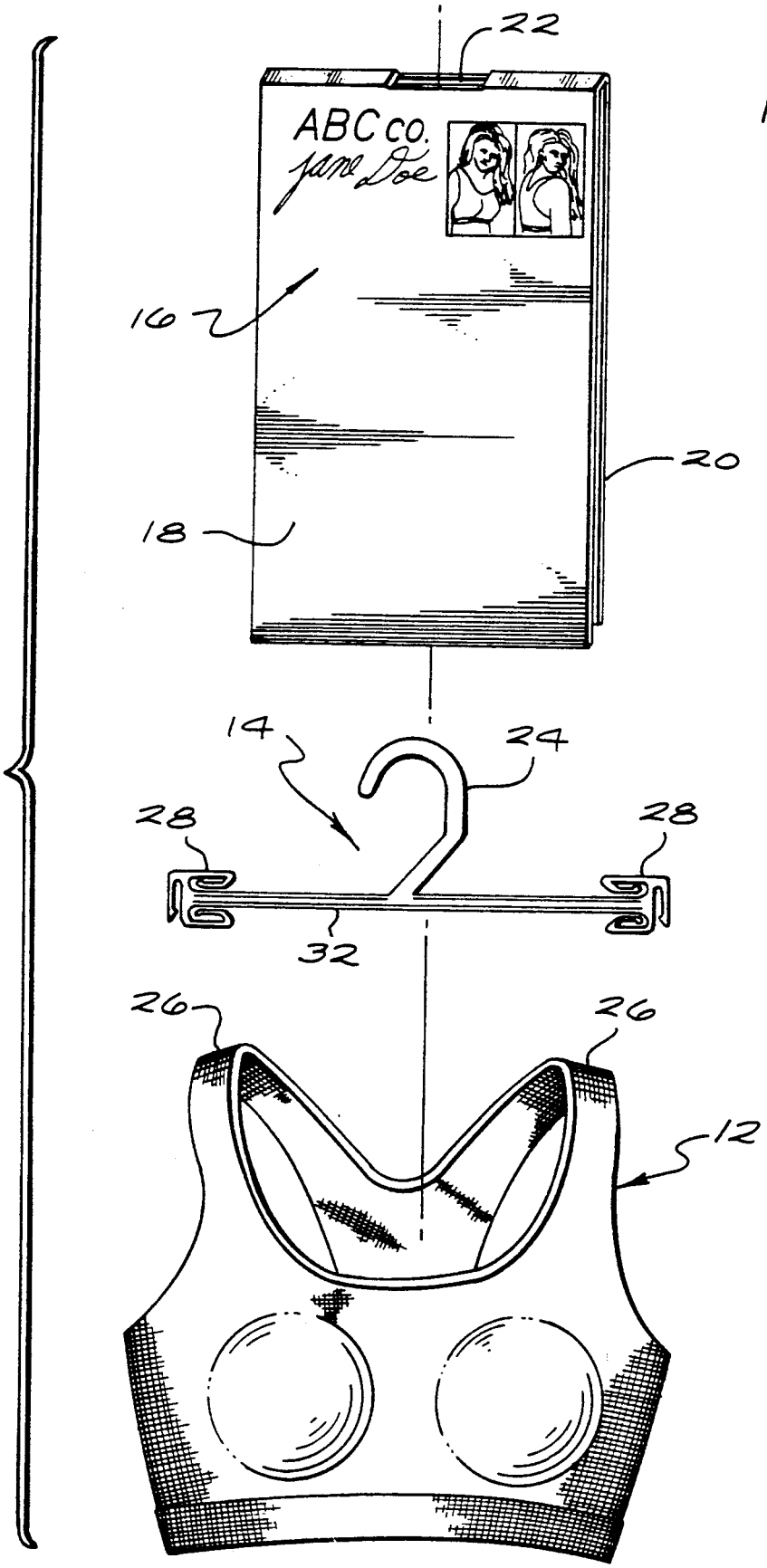
FIG. 1 is an exploded view of a bra hanger and card assembly illustrating the principles of the invention.

Referring more particularly to the drawings, FIG. 1 is an exploded view of an assembly illustrating the principles of the invention, with the sport bra 12 mounted on the hanger 14, and with the folded separator, advertising and informational sheet 16. This sheet 16 has a front panel 18 which hangs down within the garment 12, and a rear panel 20 which separates the rear of the garment from the next adjacent bra when the garments are hung side-by-side. The folded sheet 16 has an opening 22 through which the hook 24 extends when the bra is mounted on the hanger.

Figure 2:
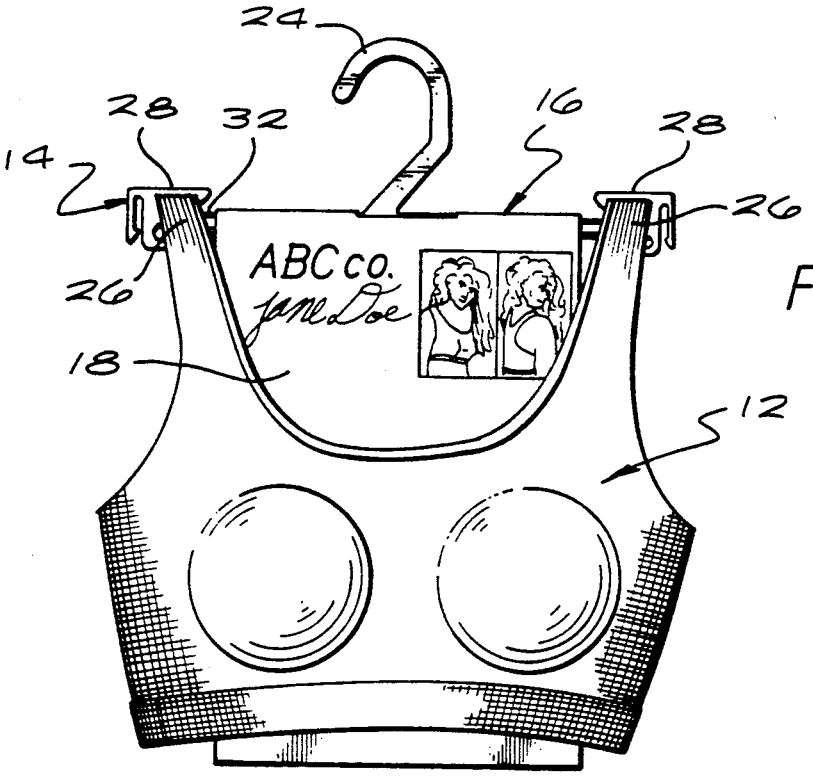
FIG. 2 is a front view of the assembly of FIG. 1.

As shown to advantage in FIG. 2, the shoulder straps 26 of the sport bra 12 may be held onto the hanger 14 by integral spring clips 28. The folded sheet 16 has the front sheet 18 thereof exposed through the low neckline of the bra 12, so that appropriate brand identification and advertising material is exposed. The card 16 may have a width slightly less than that of the transverse bar 32 of hanger 14 so that it is just within the bra shoulder straps 26. In one embodiment, the folded card was 6½ inches wide and 10½ inches in vertical extent, which was comparable to the downward extent of the sport bra 12 as it was hanging on the hanger 14.

Figure 3:
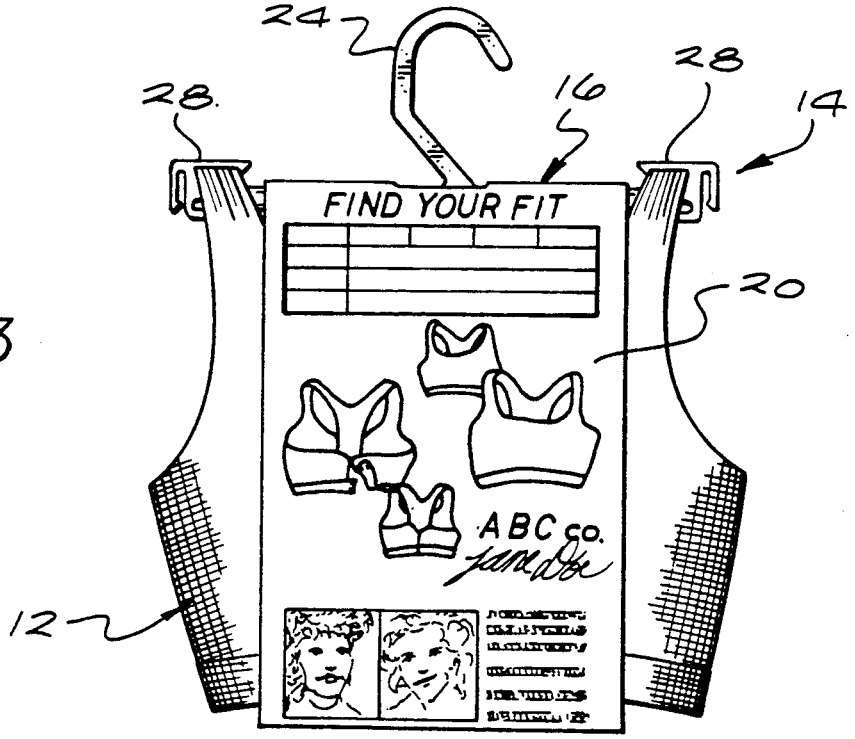
FIG. 3 is a rear view of the assembly of FIG. 1.

As shown in FIG. 3. the rear panel 20 of the folded sheet extends over the back of the garment 12. As shown in FIG. 5, which is a rear view of the sport bra 12, there are hooks 34 and mating loops 36 for adjustably securing the two sides of the back of the bra together. The rear panel 20 covers the back of the bra, including the hooks, and thus prevents adjacent bras on adjacent hangers from becoming entangled.

In FIG. 3, the rear of the back panel 20 is a "Find Your Fit" chart, which is reproduced on an enlarged scale in FIG. 4. Four bra sizes are provided, for the illustrated sports bra model, from "1" to "4", and the proper size depends on both the bra cup size and the circumference of the woman's chest, immediately below the bust. Thus, for example, as indicated in FIG. 4, a woman with a C-cup bust size, and the circumference of her chest just below the bust of 34 inches, would wear a size 2 sport bra in the illustrated model. The back side of the rear panel of the folded sheet therefore may be used to provide important fit information, as well as describing other features of the product.

As mentioned above, FIG. 5 shows the back of the sport bra 12 with the hook 34 and loops or eyes 36 for adjustment, and the "keyhole" opening 38 for additional coolness. In normal usage, the folded sheet has a transverse extent slightly less from the length of the hanger bar 32 so that it rests just within the straps 26 of the garment; and the front portion of the folded sheet is normally within the garment, while the rear sheet preferably covers the rear of the garment, as shown in FIG. 3. However, if desired, the rear portion of the folded sheet may also be placed within the garment.

FIG. 6 shows a series of assemblies 42 including (1) the hanger, (2) the bra or other garment clipped at the shoulder straps to the hanger, and (3) the folded card as discussed above. The garment-hanger-card assemblies are mounted side-by-side on the rod 44 of a merchandise display rack, with the rear panel of the folded sheet serving to separate the garments, avoiding tangling, and keeping the display neat and attractive.

While the arrangements as described above are particularly applicable to the merchandising of bras, they are also applicable to any other desired type of clothing. Other types of clothing having relatively thin shoulder straps are particularly suitable for this type of display; and typically garments of this type are bathing suits, sun back dresses and men's tank tops, although other types of garments may also be displayed in the disclosed manner.

Concerning materials and dimensions, the hangers are preferably formed of molded plastic, but metal hangers could be used. The folded sheets are preferably of light weight cardboard or fairly heavy, stiff paper, but plastic sheets could also be used. In the preferred embodiment, the plastic hanger is about eight or nine inches wide, and the folded card is 6½ inches by 10½ inches, with the folded portion interconnecting the front and rear panel being about 3/16 or ¼ inches wide and having a central opening to receive the hangers loop. The front and rear panels were of the same size, but could be of different sizes, depending on the garment being displayed, and the advertising and other information to be presented. The extent of the hanger bar could be varied depending on the product to be displayed but it would normally be between 5 and 12 inches in transverse extent.

In conclusion, it is to be understood that the foregoing detailed description and the accompanying drawings are illustrative of the principles of the invention. Other alternatives in dimensions, materials, and the garments to be displayed may be employed without departing from the spirit and scope of the invention. Thus, the card dimensions would normally be varied to accommodate the width of the hanger, and the width of the garment shoulder straps as well as the vertical extent of the garment. Other alternatives involving dimensions and materials have been mentioned hereinabove. Accordingly, the invention is not limited precisely to the embodiments as shown in the drawings and described hereinabove.

We claim:

1. A merchandising assembly for bras or other garments comprising:

a plastic hanger having a hook and a transversely extending portion for holding clothing, said transversely extending portion being between 5 inches and 12 inches in extent, and having means for securing clothing thereto at each end thereof of said transversely extending portion;

a garment mounted on said hanger at the two ends of said transversely extending portion of said hanger;

a folded sheet having a front and a rear panel, forming a display card and garment separator, having an opening at the center of the fold for receiving said hook, said folded sheet having a vertical extent corresponding substantially to that of the garment mounted on said hanger; and the front panel of said folded sheet extending down within interior of said garment, and the rear panel of said folded sheet extending down behind said garment to separate it from adjacent garments:

said display card having a transverse extent whose length is less than the transversely extending portion of said plastic hanger such that the means for securing clothing at each end of the transversely extending portion of said plastic hanger is accessible without substantial interference from said folded sheet when said folded sheet is in place.

2. A merchandising assembly as defined in claim 1 wherein advertising and product information is provided on the front of said front panel and on the back of said rear panel.

3. A merchandising assembly as defined in claim 1 wherein said garment is a bra.

4. A merchandising assembly as defined in claim 3 wherein size and fit information is set forth on the exposed back of said rear panel.

5. A merchandising assembly as defined in claim 1 wherein said garment has hooks on the rear thereof, and wherein said rear panel separates said hooks from adjacent garments, thereby preventing entanglement with such adjacent garments.

6. A merchandising assembly as defined in claim 1 wherein said hook is secured directly to said transversely extending portion of said hanger.

7. A merchandising assembly as defined in claim 1 wherein said means for securing clothing includes integrally formed clips at the ends of said transversely extending portions of said hanger.

8. A combined garment, hanger and display and separator sheet assembly comprising:

a garment having shoulder straps;

a hanger having a hook and including a transverse bar with arrangements for holding said shoulder straps near the ends of said bar;

a folded sheet having an opening substantially in the center of the fold for receiving said hook said sheet having a transverse extent slightly less than the spacing of said shoulder straps on said bar so as to permit access to the arrangement for holding said shoulder straps near the ends of said bar without substantial interference from said card; and said sheet having a front and a rear panel, with at least one of said panels extending down within interior of said garment.

9. An assembly as defined in claim 8 wherein advertising and product information is provided on the front of said front panel and on the back of said rear panel.

10. A assembly as defined in claim 8 wherein said garment is a bra.

11. An assembly as defined in claim 8 wherein size and fit information is set forth on the back of said rear panel.

12. An assembly as defined in claim 8 wherein said garment has hooks on the rear thereof, and wherein said rear panel separates said hooks from adjacent garments, thereby preventing entanglement with such adjacent garments.

13. An assembly as defined in claim 8 wherein said hook is secured directly to said transverse bar of said hanger.

14. An assembly as defined in claim 8 wherein said arrangements for holding said shoulder straps includes integrally formed clips at the ends of said transverse bar.

15. A combined garment, hanger and display and separator sheet assembly comprising:

a garment;

a hanger having a hook for mounting on a support rod, and including a transverse support member with arrangements for retaining said garment on said hanger near the ends of said transverse support member;

a folded sheet having an opening substantially in the center of the fold for receiving said hook;

said sheet having a transverse extend slightly less than the transverse extent of said support member such that said sheet does not substantially interfere with the arrangements for retaining said garment on said hanger near the ends of said supporting member when said sheet is properly installed on said hanger, and said garment is in place; and said sheet having a front and a rear panel, with at least one of said panels extending down within interior said garment.

16. An assembly as defined in claim 15 wherein advertising and product information is provided on the front of said front panel and on the back of said rear panel.

17. An assembly as defined in claim 15 wherein said garment is a bra.

18. An assembly as defined in claim 15 wherein size and fit information is set forth on the back of said rear panel.

19. An assembly as defined in claim 15 wherein said garment has hooks on the rear thereof, and wherein said rear panel separates said hooks from adjacent garments, thereby preventing entanglement with such adjacent garments.

20. An assembly as defined in claim 15 wherein said hook is secured directly to said support member of said hanger.

* * * * *